US011242982B2

(12) United States Patent
Cho et al.

(10) Patent No.: US 11,242,982 B2
(45) Date of Patent: Feb. 8, 2022

(54) LIGHTING UNIT AND RAIL TYPE LIGHTING DEVICE COMPRISING SAME

(71) Applicant: KH FEELUX CO., LTD., Gyeonggi-do (KR)

(72) Inventors: Bum Yeon Cho, Seoul (KR); Gil Hun Shin, Seoul (KR)

(73) Assignee: KH FEELUX CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/971,442

(22) PCT Filed: Dec. 27, 2018

(86) PCT No.: PCT/KR2018/016708
§ 371 (c)(1),
(2) Date: Aug. 20, 2020

(87) PCT Pub. No.: WO2019/164116
PCT Pub. Date: Aug. 29, 2019

(65) Prior Publication Data

US 2020/0400291 A1 Dec. 24, 2020

(30) Foreign Application Priority Data

Feb. 22, 2018 (KR) ..... 10-2018-0021067

(51) Int. Cl.
*F21V 21/096* (2006.01)
*F21V 21/35* (2006.01)
(Continued)

(52) U.S. Cl.
CPC ..... *F21V 21/096* (2013.01); *F21V 21/35* (2013.01); *F21V 21/005* (2013.01); *H01R 13/6205* (2013.01)

(58) Field of Classification Search
CPC ..... F21V 21/34; F21V 21/35; F21V 21/005; F21V 21/096; F21V 21/0965;
(Continued)

(56) References Cited

U.S. PATENT DOCUMENTS 5,154,509 A * 10/1992 Wulfman ..... F21V 21/096 362/227
8,220,953 B1 * 7/2012 Moore ..... F21V 17/002 362/217.01
(Continued)

FOREIGN PATENT DOCUMENTS

JP 2012-114084 A 6/2012
KR 10-1351358 B1 1/2014
(Continued)

OTHER PUBLICATIONS

International Search Report for PCT/KR2018/016708 dated Apr. 16, 2019.

*Primary Examiner* — Jong-Suk (James) Lee
*Assistant Examiner* — James M Endo
(74) *Attorney, Agent, or Firm* — The PL Law Group, PLLC

(57) ABSTRACT

A lighting unit and rail type lighting device according to an embodiment of the present invention includes a body part having a body plate and a first guide part disposed on the top of the body plate in a lengthwise direction of the body plate, a magnet material accommodation part disposed at an upper portion of the body part to accommodate a magnet material magnetically coupled with a rail unit; and a body-coupling part that is slide-coupled to each of both ends of the body part along the first guide part.

16 Claims, 9 Drawing Sheets

(51) Int. Cl.
*H01R 13/62* (2006.01)
*F21V 21/005* (2006.01)

(58) Field of Classification Search
CPC ..... H01R 25/147; H01R 25/142; H01R 25/6205; H01R 25/145; H01R 25/161; H01R 25/162; H01R 25/14; H01R 13/6205
See application file for complete search history.

(56) References Cited

U.S. PATENT DOCUMENTS

2005/0237769 A1* 10/2005 Hong ..... H01R 25/147 362/648
2009/0279298 A1* 11/2009 Mier-Langner .... H01R 13/6205 362/235
2010/0233889 A1* 9/2010 Kiani ..... A61B 5/6826 439/39
2012/0075857 A1* 3/2012 Verbrugh ..... F21V 29/73 362/249.01
2012/0242213 A1* 9/2012 Shim ..... H01K 1/44 313/46
2012/0274189 A1* 11/2012 Attey ..... A47F 11/10 312/114
2013/0294081 A1* 11/2013 O'Connor ..... F21S 8/038 362/285
2014/0112001 A1* 4/2014 Noh ..... F21V 23/005 362/311.01
2014/0162468 A1* 6/2014 Kim ..... H01R 13/2421 439/39
2015/0070884 A1* 3/2015 Wu ..... F21V 21/0832 362/221
2015/0226384 A1* 8/2015 Park ..... F21V 21/34 362/223
2015/0311689 A1* 10/2015 Noh ..... H02G 3/305 362/147
2016/0195250 A1* 7/2016 Park ..... F21S 2/005 362/219

FOREIGN PATENT DOCUMENTS

KR 10-2015-0086843 A 7/2015
KR 10-1532869 B1 7/2015
KR 10-2015-0133981 A 12/2015

* cited by examiner

LIGHTING UNIT AND RAIL TYPE LIGHTING DEVICE COMPRISING SAME

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2018/016708, filed Dec. 27, 2018, which claims priority to the benefit of Korean Patent Application No. 10-2018-0021067 filed in the Korean Intellectual Property Office on Feb. 22, 2018, the entire contents of which are incorporated herein by reference.

TECHNICAL FIELD

The present invention relates to a lighting technology, and more particularly, to a lighting unit and a rail type lighting device including same.

BACKGROUND ART

In recent years, a rail type lighting device that installs a rail on a ceiling or a wall surface and mounts a lighting to be movable along a rail has been widely used. The rail type lighting device requires physical coupling and electrical coupling between the rail and the lighting. To this end, the rail and the lighting have complex structures and thus an assembly process thereof becomes complex.

SUMMARY

An embodiment of the present invention provides a lighting unit capable of improving a coupling force between a rail unit and a lighting unit and a rail type lighting device including same.

An embodiment of the present invention also provides a lighting unit having improved ease of assembly and a rail type lighting device including same.

An embodiment of the present invention provides a lighting unit including: a body part including a body plate and a first guide part disposed on the top of the body plate in a lengthwise direction of the body plate; a magnet material accommodation part disposed on an upper portion of the body part to accommodate a magnet material that is magnetically coupled with a rail unit; and a body-coupling part that is slide-coupled to each of both ends of the body part along the first guide part.

In an embodiment, a protruding part that protrudes toward the rail unit may be disposed at a central portion of the body part, the body-coupling part may have the bottom that closely contacts one end of the body part and the top that protrudes from the body part to the magnet material accommodation part, and a distance between the one end of the body part to an end of the top of the body-coupling part may be equal to or less than that between the one end of the body part to one end of the protruding part.

In an embodiment, the rail unit may include a coupling projection part that protrudes toward the lighting unit, and the lighting unit may further include a rail coupling part that is fixed to the body-coupling part and coupled with the coupling projection part.

In an embodiment, the rail coupling part may include: a basic frame seated on an end of the body-coupling part and including a projection part insertion groove to which the coupling projection part is inserted; a connection part disposed on one surface of the basic frame; and a first elastic coupling part disposed on an end of the connection part and to which the coupling projection part is inserted and coupled.

In an embodiment, the first elastic coupling part may include a first-1 elastic coupling part and a first-2 elastic coupling part, the basic frame may include a first basic frame, a second basic frame that protrudes from one side of one surface of the first basic frame, and a third basic frame that protrudes from the other side of the one surface of the first basic frame, and the connection part may include a first connection part disposed inward from the bottom of the second basic frame to connect the second basic frame and the first-1 elastic coupling part and a second connection part disposed inward from the bottom of the third basic frame to connect the third basic frame and the first-2 elastic coupling part.

In an embodiment, the rail coupling part may be pressed from an upper portion to a lower portion of an end of the body-coupling part and coupled with the body-coupling part, and the lighting unit may include a second elastic coupling part disposed on each of both sides of the basic frame; and a catching hole defined in each of both side surfaces of the body-coupling part and to which the second elastic coupling part is inserted and caught.

In an embodiment, the magnet material accommodation part may be slide-coupled to the top of the body part along the first guide part.

In an embodiment, the body part may be made of a metal material, the magnet material accommodation part may be made of an insulating material, and the magnet material may be electrically insulated from the body part by the magnet material accommodation part.

In an embodiment, the first guide part may protrude upward from each of both sides of the body plate, the lighting unit may include a first-1 guide groove defined in an inside of the first guide part in a lengthwise direction of the first guide part and a first-2 guide groove defined in an outside of the first guide part in the lengthwise direction of the first guide part, and the magnet material accommodation part may have an inner space to which the first guide part is inserted and both side bottoms that are inserted to and slid along the first-1 guide groove and first-2 guide groove, respectively.

In an embodiment, the lighting unit may further include a connection part that is electrically connected to a conductive line of the rail unit, and the top of the connection part may have a height greater than that of the magnet material.

In an embodiment, the lighting unit may further include: a first connection part that is electrically connected to a first conductive line of the rail unit; and a second connection part that is electrically connected to a second conductive line of the rail unit.

In an embodiment, the lighting unit may further include: a body-coupling part that is slide-coupled to each of both ends of the body part along the first guide part; a first accommodation hole defined in the body-coupling part to accommodate the first connection part; and a second accommodation hole defined in the body part to accommodate the second connection part.

In an embodiment, the body-coupling part may include: a base plate disposed along a lengthwise direction of the lighting unit; a first side plate disposed at one side of the base plate; a second side plate disposed at the other side of the base plate; and a guide coupling part that protrudes from the tops of the first side plate and the second side plate to the body part and is slide-coupled to the first guide part.

In an embodiment, the body-coupling part may further include a third accommodation hole disposed in communication with the second accommodation hole in the guide coupling part to expose the top of the second connection part.

In an embodiment, the body-coupling part may include: a protruding connection part that protrudes toward the first accommodation hole from an inside of the base plate; a vertical part disposed perpendicularly to an end of the protruding connection part in an upward direction; and a cover part that protrudes from an end of the vertical part to the first connection part to cover the top of the first connection part.

In an embodiment, the body part and the magnet material accommodation part may be integrated with each other, and each of the body part and the magnet material accommodation part may be made of an insulating material.

In an embodiment of the present invention, a lighting unit that is coupled with a rail unit, in which a coupling projection part protrudes from one surface thereof and at least one conductive line is disposed along a lengthwise direction thereof, and is electrically connected to the rail unit, includes: a body part; a lighting part disposed at a lower portion of the body part; one pair of body-coupling parts coupled to both ends of the body part, respectively; a rail coupling part fixed to the body-coupling part and coupled with the coupling projection part; a magnet material accommodation part disposed between the one pair of body-coupling parts on the top of the body part; and a magnet material accommodated in the magnet material accommodation part and magnetically coupled with the conductive line.

In an embodiment of the present invention, a rail type lighting device includes: a mounting unit mounted to an installation surface; a rail unit coupled with the mounting unit and disposed in a lengthwise direction of the mounting unit; and a lighting unit that is coupled with the rail unit, electrically connected with the rail unit, and movable along the rail unit. Here, the rail unit includes: a rail body coupled with the mounting unit inside the mounting unit; a coupling projection part that protrudes from one surface of the rail body; and a conductive line disposed along a lengthwise direction of the rail body on at least one of both side surfaces of the coupling projection part and one surface of the rail body. Also, the lighting unit includes: a body part; a magnet material accommodation part disposed at an upper portion of the body part; a magnet material accommodated in the magnet material accommodation part and magnetically coupled with the conductive line; and a lighting part connected to the body part and configured to receive power from the conductive line.

In an embodiment, the body part may include a body plate and a first guide part disposed in a lengthwise direction of the body plate on the top of the body plate, and the lighting unit may further include a body-coupling part that is slide-coupled to each of both ends of the body part along the first guide part.

In an embodiment, the lighting unit may further include a rail coupling part fixed to the body-coupling part and coupled with the coupling projection part.

According to the embodiment of the present invention, as the magnet material of the lighting unit and the conductive line of the rail unit are magnetically coupled (primary coupling), and the coupling projection part of the rail unit and the rail coupling part of the lighting unit are mechanically (or physically) coupled (secondary coupling), the coupling force between the rail unit and the lighting unit may improve.

Also, since the components are coupled through the mutual slide-coupling, the separate coupling member is unnecessary. Thus, the number of the components may be reduced, the assembly between the components may be easily performed, and the assembly time may be reduced.

DETAILED DESCRIPTION

Figure 1:
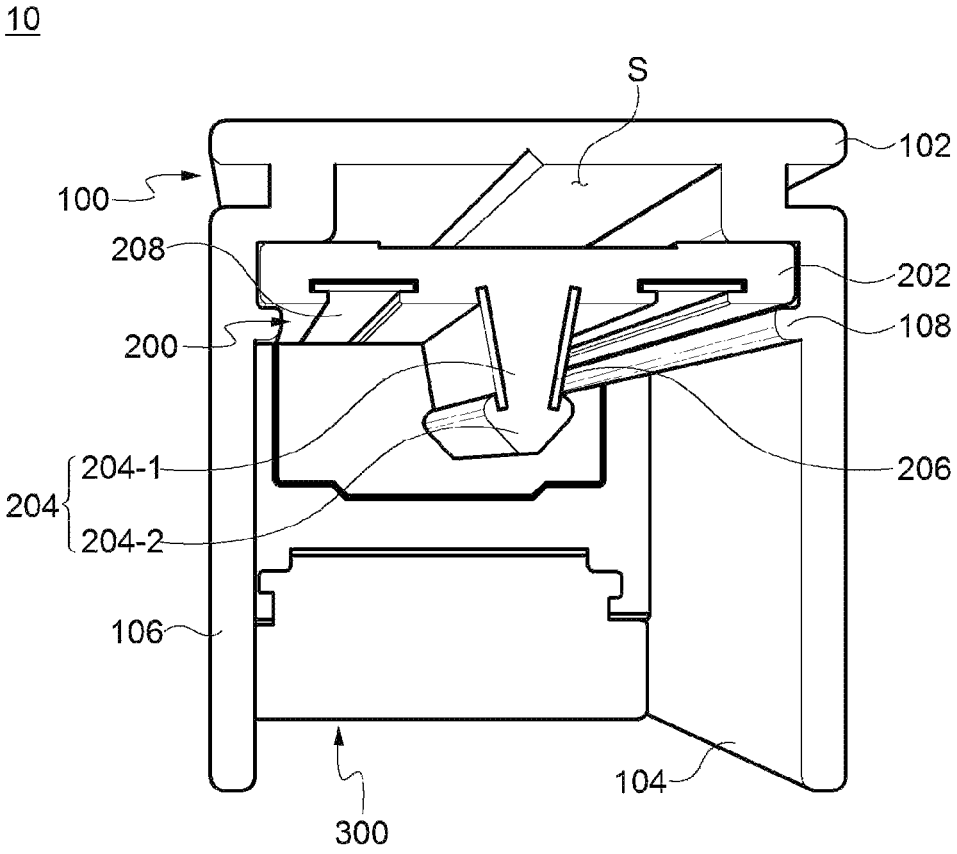
FIG. 1 is a perspective view illustrating a rail type lighting device according to an embodiment of the present invention.

Hereinafter, exemplary embodiments of the present invention will be explained in detail with reference to the accompanying drawings. Following detailed description will be provide for more general understanding on methods, devices, and/or systems in this specification. However, this is merely an example, and the embodiments of the present invention are not limited thereto.

Moreover, detailed descriptions related to well-known functions or configurations will be ruled out in order not to unnecessarily obscure subject matters of the present invention. Also, terms used in this specification are terms defined in consideration of functions according to embodiments, and thus the terms may be changed according to the intension or usage of a user or operator. Therefore, the terms should be defined on the basis of the overall contents of this specification. Terms used herein are for describing the embodiments of the present invention and not restrictive. The terms of a singular form may include plural forms unless referred to the contrary. The meaning of "include," "comprise," "including," or "comprising," specifies a property, a region, a fixed number, a step, a process, an element and/or a component but does not exclude other properties, regions, fixed numbers, steps, processes, elements and/or components.

In the following description, terms having the meaning of "transmitting", "communicating", "sending", "receiving", or other similar meanings represent that a signal or information is directly transmitted from one component to another component or indirectly transmitted through another component. Particularly, the feature of "transmitting" or "sending" the signal or the information to one component indicates the final destination of the signal or the information instead of the direct destination. This is true for the "receiving" of the signal or the information. Also, in this specification, the feature in which two or more data or information are "related" represents that when one data (or information) is acquired, at least a part of other data (or information) may be acquired on the basis of the acquired data (or information).

Spatially relative terms, such as "below", "lower", "above", "upper" and the like, may be used herein for ease of description to describe an element and/or a feature's relationship to another element(s) and/or feature(s) as illustrated in the figures. It will be understood that the spatially relative terms are intended to encompass different orientations of the device in use or operation in addition to the orientation depicted in the drawings.

It will be understood that although the terms of first and second are used herein to describe various elements, these elements should not be limited by these terms. The terms are only used to distinguish one component from other components. For example, a first element referred to as a first element in one embodiment can be referred to as a second element in another embodiment.

FIG. 1 is a perspective view illustrating a rail type lighting device according to an embodiment of the present invention.

Referring to FIG. 1, a rail type lighting device 10 may include a mounting unit 100, a rail unit 200, and a lighting unit 300.

The mounting unit 100 may be mounted to a surface (installation surface) on which the rail type lighting device 10 is installed. Here, the installation surface may be an indoor wall surface or ceiling. However, the embodiment of the present invention is not limited thereto. For example, the installation surface may be a surface of a structure (e.g. furniture). The mounting unit 100 may have a predetermined length along the installation surface.

The mounting unit 100 may include a mounting part 102, a first side part 104, and a second side part 106. The mounting part 102 is a portion mounted to the installation surface. The mounting part 102 may be disposed parallel to the installation surface. The mounting part 102 may include a surface contacting the installation surface.

The first side part 104 may be disposed in a downward direction from one side of the mounting part 102. The first side part 104 may be disposed perpendicularly to the mounting part 102. The first side part 104 may be disposed in a lengthwise direction of the mounting unit 100 from the one side of the mounting part 102.

The second side part 106 may be disposed in a downward direction from the other side of the mounting part 102. The second side part 106 may be disposed perpendicularly to the mounting part 102. The second side part 106 may be disposed in the lengthwise direction of the mounting unit 100 from the other side of the mounting part 102.

An accommodation space S may be defined in the mounting unit 100 by the mounting part 102, the first side part 104, and the second side part 106. The mounting unit 100 may have an opened lower portion. The rail unit 200 may be accommodated in the accommodation space S. A first coupling part 108, to which the rail unit 200 is able to be slide-coupled, may be formed on an inner surface of each of the first side part 104 and the second side part 106.

The first coupling part 108 may be provided on the inner surface of each of the first side part 104 and the second side part 106 in the lengthwise direction of the mounting unit 100. In an exemplary embodiment, the first coupling part 108 may be provided with a seating projection shape on the inner surface of each of the first side part 104 and the second side part 106. In this case, when the rail unit 200 is inserted to the accommodation space S, bottom surfaces of both sides of the rail unit 200 may be slid while being seated on the seating projections.

Alternatively, the first coupling part 108 may be provided with an insertion groove shape in the inner surface of each of the first side part 104 and the second side part 106. In this case, when the rail unit 200 is inserted to the accommodation space S, both side surfaces of the rail unit 200 may be slid while being inserted to the insertion grooves. However, the embodiment of the present invention is not limited thereto. For example, the mounting unit 100 and the rail unit 200 may be coupled by using an adhesive or by various methods such as screw coupling.

The rail unit 200 may be accommodated in the mounting unit 100. The rail unit 200 may be provided in the mounting unit 100 in the lengthwise direction of the mounting unit 100. The rail unit 200 may be slide-coupled with the mounting unit 100 in the mounting unit 100. The rail unit 200 may include a rail body 202, a coupling projection part 204, a first conductive line 206, and a second conductive line 208.

The rail body 202 may be slide-coupled with the mounting unit 100 in the mounting unit 100. The rail body 202 may be provided in the lengthwise direction of the mounting unit 100. For example, the rail body 202 may have a plate shape. However, the embodiment of the present invention is not limited thereto.

The coupling projection part 204 is a portion by which the rail unit 200 is coupled with the lighting unit 300. The coupling projection part 204 may protrude from one surface (i.e., a surface facing the lighting unit 300) of the rail body 202. The coupling projection part 204 may be disposed at a central portion of one surface of the rail body 202 in a lengthwise direction of the rail body 202.

The coupling projection part 204 may include a first coupling projection part 204-1 and a second coupling projection part 204-2. The first coupling projection part 204-1 may protrude from one surface of the rail body 202. The first coupling projection part 204-1 may have a width that gradually decreases in a downward direction. That is, the first coupling projection part 204-1 may have both side surfaces that are inclined toward a vertical central axis of the first coupling projection part 204-1.

The second coupling projection part 204-2 may extend from an end of the first coupling projection part 204-1. The top of the second coupling projection part 204-2 may have a width greater than that of the bottom of the first coupling projection part 204-1. The second coupling projection part 204-2 may include a section in which a width gradually decreases in a downward direction.

The first conductive line 206 may be disposed on each of both side surfaces of the coupling projection part 204. The first conductive line 206 may be disposed in a lengthwise direction of the coupling projection part 204. In an exemplary embodiment, the first conductive line 206 may be disposed on each of both side surfaces of the first coupling projection part 204-1. In an exemplary embodiment, the first conductive line 206 may be inserted to each of grooves defined in both side surfaces of the first coupling projection part 204-1. In an exemplary embodiment, the first conductive line 206 may be a conductive line for power supply.

The second conductive line 208 may be disposed on one surface of the rail body 202. The second conductive line 208 may be disposed in the lengthwise direction of the rail body 202. The second conductive lines 208 may be disposed on one surface of the rail body 202 with the coupling projection part 204 therebetween. The second conductive line 208 may be inserted to a groove defined in one surface of the rail body 202. In an exemplary embodiment, the second conductive line 208 may be a conductive line for lighting control (e.g., dimming control, color temperature control, etc.)

One of the first conductive line 206 and the second conductive line 208 may be used for power supply, and the other thereof may be used for lighting control. Alternatively, all of the first conductive line 206 and the second conductive line 208 may be used for power supply or for lighting control.

Although the rail unit 200 includes all of the first conductive line 206 and the second conductive line 208, the embodiment of the present invention is not limited thereto. For example, the rail unit 200 may include only one of the first conductive line 206 and the second conductive line 208.

The lighting unit 300 may be coupled with the rail unit 200 at a lower portion of the rail unit 200. Here, the first side part 104 and the second side part 106 may cover both sides of the lighting unit 300. The lighting unit 300 may be disposed in a spaced between the first side part 104 and the second side part 106 below the rail unit 200. Also, the lighting unit 300 may be electrically connected to the rail unit 200. The lighting unit 300 may receive power from the rail unit 200. The lighting unit 300 may receive a lighting control signal from the rail unit 200.

Figure 2:
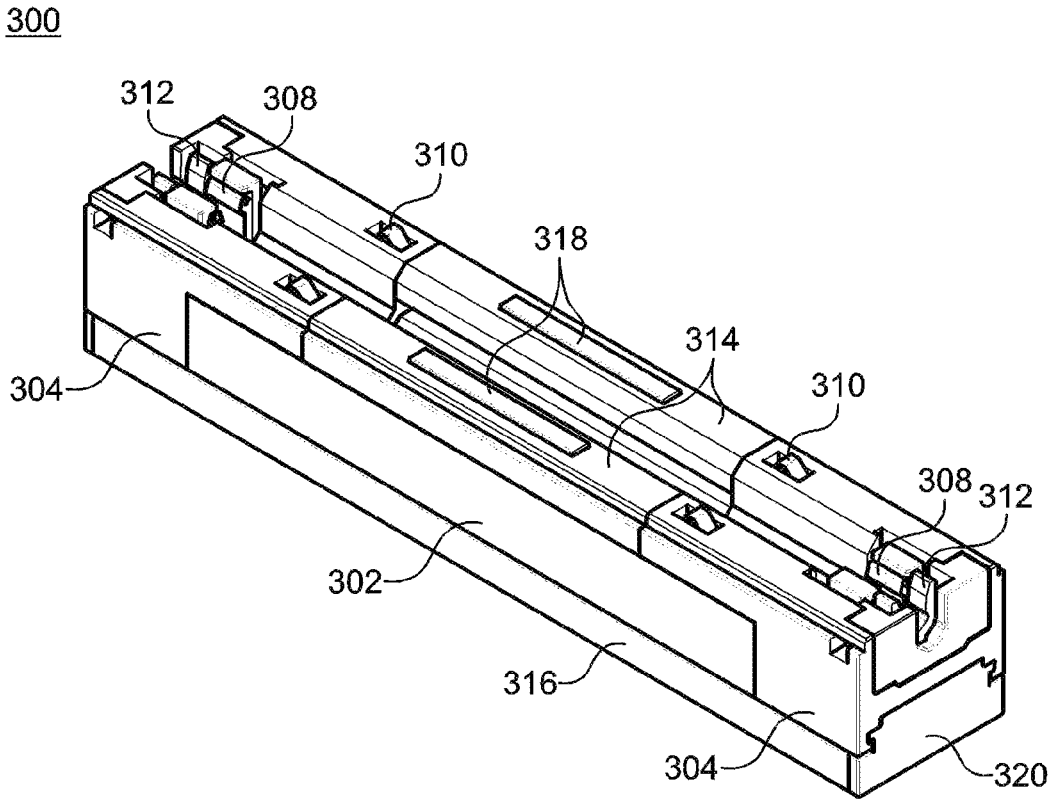
FIG. 2 is a perspective view illustrating a lighting unit according to an embodiment of the present invention.
Figure 3:
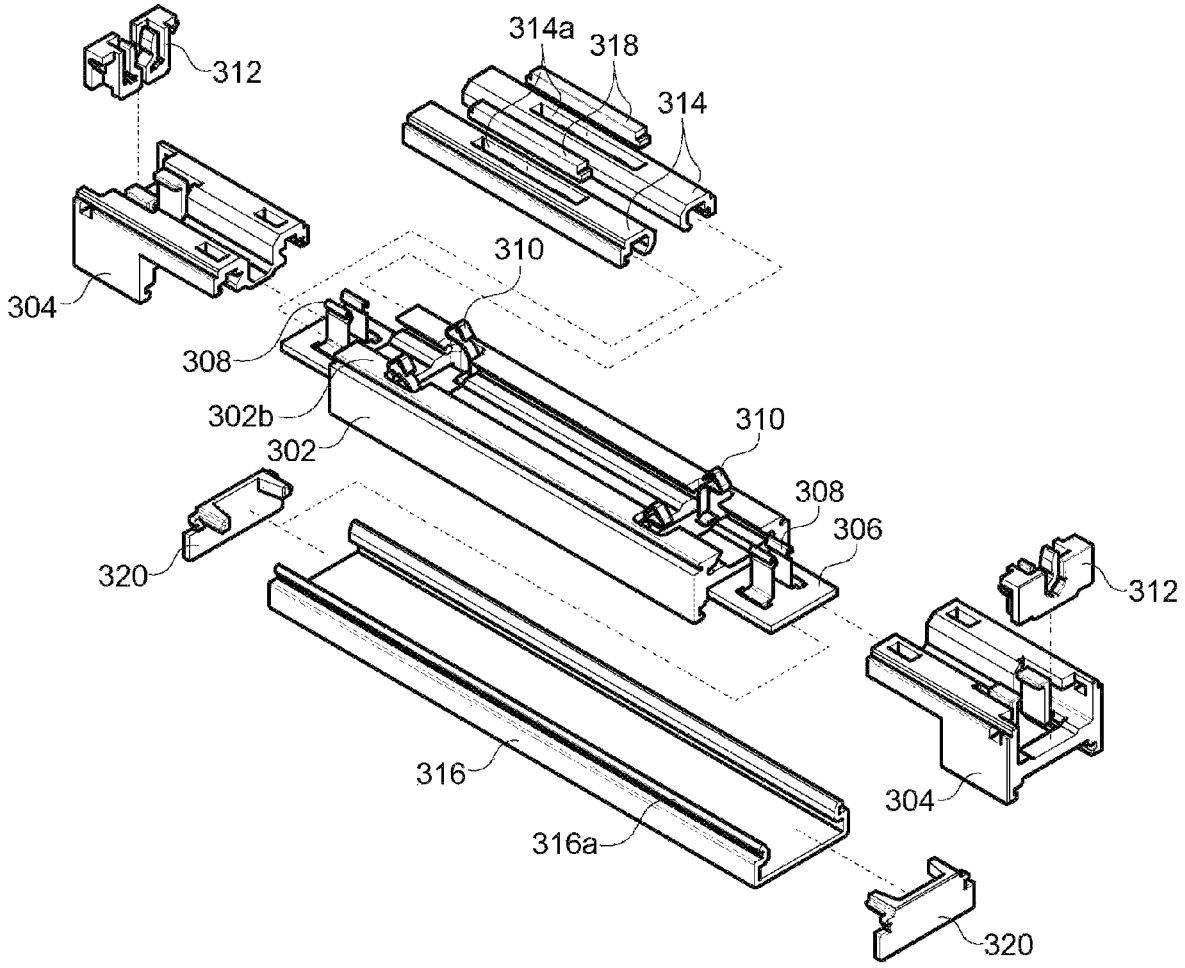
FIG. 3 is an exploded perspective view illustrating the lighting unit according to an embodiment of the present invention.

FIG. 2 is a perspective view illustrating the lighting unit 300 according to an embodiment of the present invention, and FIG. 3 is an exploded perspective view illustrating the lighting unit 300 according to an embodiment of the present invention.

Referring to FIGS. 2 and 3, the lighting unit 300 may include a body part 302, a body-coupling part 304, a lighting part 306, a first connection part 308, a second connection part 310, a rail coupling part 312, a magnet material accommodation part 314, and a diffusion part 316.

Figure 4:
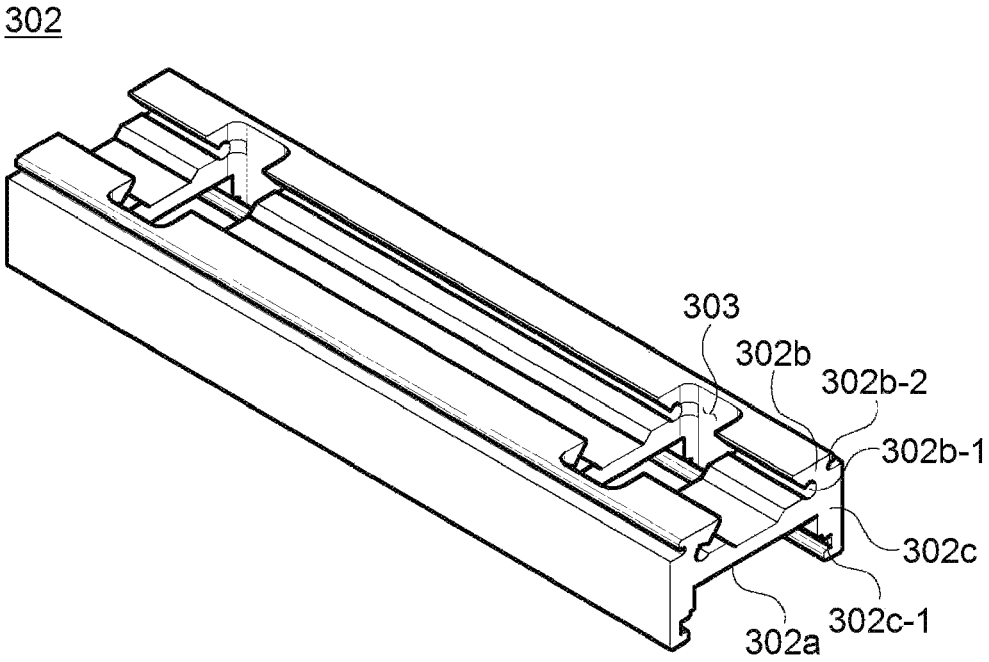
FIG. 4 is a perspective view illustrating a body part according to an embodiment of the present invention.

The body part 302 may be disposed in a lengthwise direction of the lighting unit 300. In an exemplary embodiment, the body part 302 may be made of a metal material. In this case, heat dissipation may be performed through the body part 302. However, the embodiment of the present invention is not limited thereto. For example, the body part 302 may be made of an insulating material. FIG. 4 is a perspective view illustrating the body part 302 according to an embodiment of the present invention.

Referring to FIG. 4, the body part 302 may include a body plate 302*a*, a first guide part 302*b*, and a second guide part 302*c*.

The body plate 302*a* may be disposed in the lengthwise direction of the lighting unit 300. The body plate 302*a* may have a flat plate shape. However, the embodiment of the present invention is not limited to the shape of the body plate 302*a*.

The first guide part 302*b* may protrude from each of both sides of the body plate 302*a*. The first guide part 302*b* may be disposed in a lengthwise direction of the body plate 302*a*. A first-1 guide groove 302*b*-1 may be defined in an inside of the first guide part 302*b* in a lengthwise direction of the first guide part 302*b*. Also, a first-2 guide groove 302*b*-2 may be defined in an outside of the first guide part 302*b* in the lengthwise direction of the first guide part 302*b*.

The second guide part 302*c* may protrude from each of both sides of the body plate 302*a*. The second guide part 302*c* may be disposed in the lengthwise direction of the body plate 302*a*. A second guide groove 302*c*-1 may be defined in an inside the second guide part 302*c* in a lengthwise direction of the second guide part 302*c*. Also, the lighting part 306 may be accommodated in a space between the second guide parts 302*c* protruding from lower portions of both sides of the body plate 302*a*, respectively.

Figure 5:
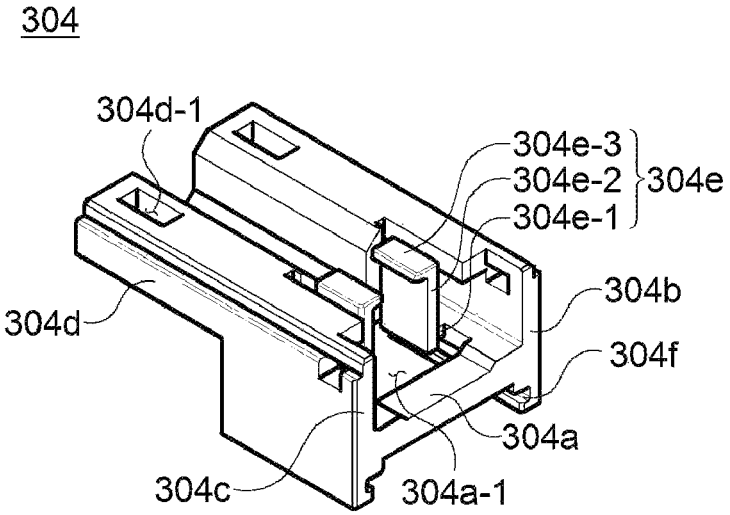
FIG. 5 is a perspective view illustrating a body-coupling part according to an embodiment of the present invention when viewed from above.
Figure 6:
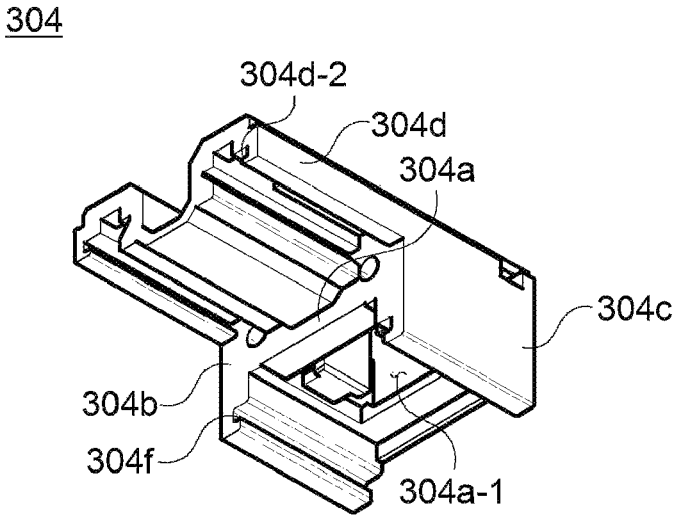
FIG. 6 is a perspective view illustrating the body-coupling part according to an embodiment of the present invention when viewed from below.

Referring to FIGS. 2 and 3 again, the body-coupling parts 304 may be coupled to both ends of the body part 302, respectively. FIG. 5 is a perspective view illustrating the body-coupling part 304 according to an embodiment of the present invention when viewed from above, and FIG. 6 is a perspective view illustrating the body-coupling part 304 according to an embodiment of the present invention when viewed from below. Referring to FIGS. 5 and 6, the body-coupling part 304 may include a base plate 304*a*, a first side plate 304*b*, a second side plate 304*c*, a guide coupling part 304*d*, and a first connection part support part 304*e*.

The base plate 304*a* may be disposed in the lengthwise direction of the lighting unit 300. A first accommodation hole 304*a*-1 for providing a space for accommodating the first connection part 308 may be defined in the base plate 304*a*. The first accommodation hole 304*a*-1 may pass through the base plate 304*a* in a vertical direction.

Also, a second accommodation hole 303 for providing a space for accommodating the second connection part 310 may be defined in the body part 302. The second accommodation hole 303 may pass through the body part 302 in the vertical direction (refer to FIG. 4).

The first side plate 304*b* may be disposed perpendicularly to one side of the base plate 304*a*. The first side plate 304*b* may be disposed perpendicularly in each of upward and downward directions at the one side of the base plate 304*a*.

The second side plate 304*c* may be disposed perpendicularly to the other side of the base plate 304*a*. The second side plate 304*c* may be disposed perpendicularly in each of upward and downward directions at the other side of the base plate 304*a*. A third guide groove 304*f* may be defined at the bottom of each of the first side plate 304*b* and the second side plate 304*c* in a lengthwise direction of the body-coupling part 304.

The guide coupling part 304*d* may protrude toward the body part 302 from each of the tops of the first side plate 304*b* and the second side plate 304*c*.

A third accommodation hole 304*d*-1 for accommodating the top of the second connection part 310 may be define din the guide coupling part 304*d*. The third accommodation hole 304*d*-1 may pass through the guide coupling part 304*d* in the vertical direction. When the body-coupling part 304 is coupled with the body part 302, the third accommodation hole 304*d*-1 may communicate with the second accommodation hole 303. The top of the second connection part 310 may be exposed to the outside through the third accommodation hole 304*d*-1.

The guide coupling part 304*d* may be slide-coupled to the first guide part 302*b* of the body part 302. That is, a guide coupling groove 304*d*-2 to which the first guide part 302*b* is insertable may be defined in the guide coupling part 304*d* in a lengthwise direction of the guide coupling part 304*d*. The guide coupling groove 304*d*-2 may have a shape corresponding to that of the first guide part 302*b*. When the guide coupling part 304*d* moves to the body part 302, the inside (i.e., both sides of the guide coupling groove 304*d*-2) of the coupling part 304*d* may be slide-coupled to the first-1 guide groove 302*b*-1 and the first-2 guide groove 302*b*-2.

The first connection part support part 304*e* may include a protruding connection part 304*e*-1, a vertical part 304*e*-2, and a cover part 304*e*-3. The protruding connection part 304*e*-1 may protrude from an inside of the base plate 304*a* toward the first accommodation hole 304*a*-1.

The vertical part 304*e*-2 may be disposed perpendicularly from an end of the protruding connection part 304*e*-1 in an upward direction. The vertical part 304*e*-2 may have a height corresponding to the first connection part 308. The cover part 304*e*-3 may protrude from an end of the vertical part 304*e*-2 to the first connection part 308. The cover part 304*e*-3 may cover the top of the first connection part 308.

Referring to FIGS. 2 and 3 again, the lighting part 306 may be accommodated at a lower portion of the body part 302. For example, the lighting part 306 may be accommodated in a space between the second guide parts 302*c*. The lighting part 306 may have a substrate shape on which a light emitting device (not shown) is mounted. The lighting part 306 may be disposed in the lengthwise direction of the lighting unit 300.

The first connection part 308 and the second connection part 310 may be fixed to one surface (a surface facing the body plate 302*a*) of the lighting part 306. At least one light emitting device (e.g., LED) may be mounted to the other surface (a surface facing the diffusion part 316) of the lighting part 306.

The first connection part 308 may be fixed to one surface of the lighting part 306. The first connection part 308 may be electrically connected to the lighting part 306. For example, the first connection part 308 may be disposed on both ends of the one surface of the lighting part 306. Also, the second connection part 310 may be spaced apart from the first connection part 308 on the one surface of the lighting part 306. The second connection part 310 may be electrically connected to the lighting part 306.

Figure 7:
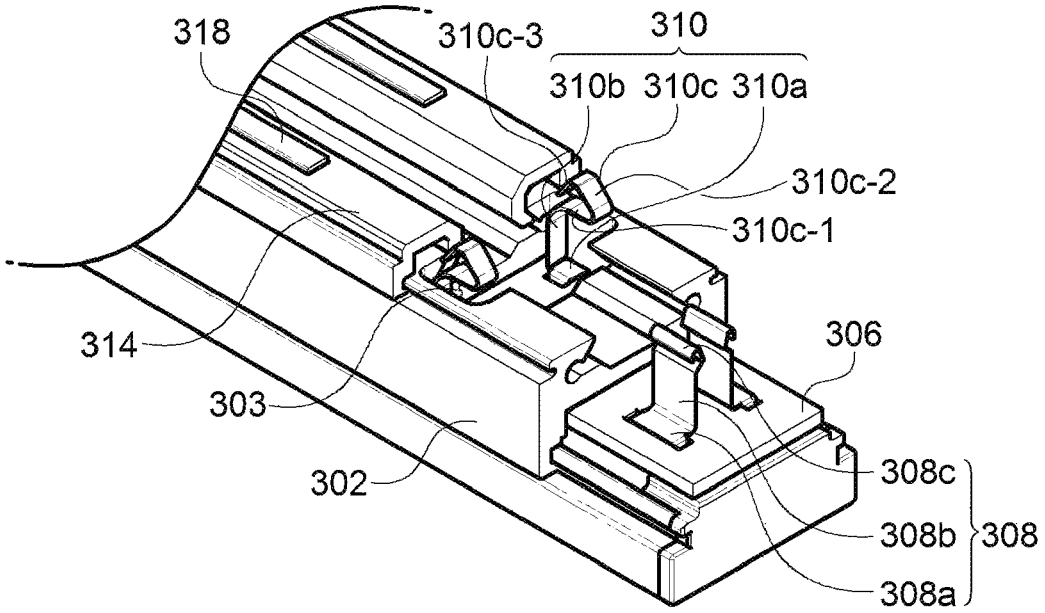
FIG. 7 is a perspective view illustrating a first connection part and a second connection part in the lighting unit according to an embodiment of the present invention.

FIG. 7 is a perspective view illustrating the first connection part 308 and the second connection part 310 in the lighting unit 300 according to an embodiment of the present invention.

Referring to FIG. 7, one pair of first connection parts 308 may face each other in a width direction of the lighting part 306 on one surface of the lighting part 306. Each of the first connection parts 308 may include a first fixing part 308*a*, a first vertical connection part 308*b*, and a first line contact part 308*c*.

The first connection part 308*a* may be fixed to one surface of the lighting part 306. The first connection part 308*a* may be electrically connected to the light emitting device (not shown) disposed on the other surface of the lighting part 306. The first vertical connection part 308*b* may connect the first fixing part 308*a* and the first line contact part 308*c*. The first vertical connection part 308*b* may be disposed perpendicularly to the lighting part 306 from an end of the first connection part 308*a*.

The first line contact part 308*c* may be disposed on an end of the first vertical connection part 308*b*. When the rail unit 200 and the lighting unit 300 are coupled, the first line contact part 308*c* may contact the first conductive line 206. In this case, power may be supplied to the light emitting device (not shown) through the first conductive line 206 and the first connection part 308. The first line contact part 308*c* may have a hook shape to efficiently contact the first conducive line 206. However, the embodiment of the present invention is not limited thereto. For example, the first conducive line 206 may contact the first vertical connection part 308*b*.

One pair of second connection parts 310 may be disposed parallel to each other in the lengthwise direction of the lighting part 306 on one surface of the lighting part 306. Each of the second connection parts 310 may be fixed to the one surface of the lighting part 306 in the second accommodation hole 303 of the body part 302. The second connection part 310 may include a second fixing part 310*a*, a second vertical connection part 310*b*, and a second line contact part 310*c*.

The second fixing part 310*a* may be fixed to the one surface of the lighting part 306. The second fixing part 310*a* may be electrically connected to the light emitting device (not shown) disposed on the other surface of the lighting part 306. The second vertical connection part 310*b* may connect the second fixing part 310*a* and the second line contact part 310*c*. The second vertical connection part 310*b* may be disposed perpendicularly to the lighting part 310 from an end of the second connection part 310*a*.

The second line contact part 310*c* may be disposed on an end of the second vertical connection part 310*b*. When the rail unit 200 and the lighting unit 300 are coupled, the second line contact part 310*c* may contact the second conductive line 208. In this case, a lighting control signal may be transmitted to the light emitting device (not shown) through the second conductive line 208 and the second connection part 310.

Here, the second line contact part 310*c* may be exposed to the outside through the third accommodation hole 304*d*-1 of the body-coupling part 304. In this state, the second line contact part 310*c* may contact the second conductive line 208. Here, the second connection part 310 may have a structure of supplying an elastic force in a direction toward the second conductive line 208 in order to maintain the contact with the second conductive line 208.

In an exemplary embodiment, the second line contact part 310*c* may include a first bent part 310*c*-1, a second bent part 310*c*-2, and a third bent part 310*c*-3. The first bent part 310*c*-1 may be disposed perpendicularly to the second vertical connection part 310*b* (i.e., in parallel to the lighting part 306) in a first direction from an end of the second vertical connection part 310*b*. The second bent part 310*c*-2 may be inclined upward in a second direction that is opposite to the first direction from an end of the first bent part 310*c*-1. The third bent part 310*c*-3 may be inclined downward from an end of the second bent part 310*c*-2.

The above-described shape of the second connection part 310 may allow the magnet material accommodation part 314 to be easily slide-mounted to or detached from the body part 302. Also, when the magnet material accommodation part 314 is slide-mounted or detached, the second connection part 310 may not be deformed in shape and prevented from being damaged.

Here, the top of the second connection part 310 may have a height greater than that of a magnet material 318. That is, the second line contact part 310*c* of the second contact part 310 may protrude upward further than the magnet material 318 (protrude toward the rail unit 200) in FIG. 7. Thus, when the second connection part 310 contacts the second conductive line 208, the second connection part 310 may stably maintain electrical contact by the elastic force thereof.

Referring to FIGS. 2 and 3 again, the rail coupling part 312 may be coupled to an end of the body-coupling part 304. As the rail coupling part 312 is coupled with the coupling projection part 204 of the rail unit 200, the rail unit 200 and the lighting unit 300 may be physically coupled to each other.

Figure 8:
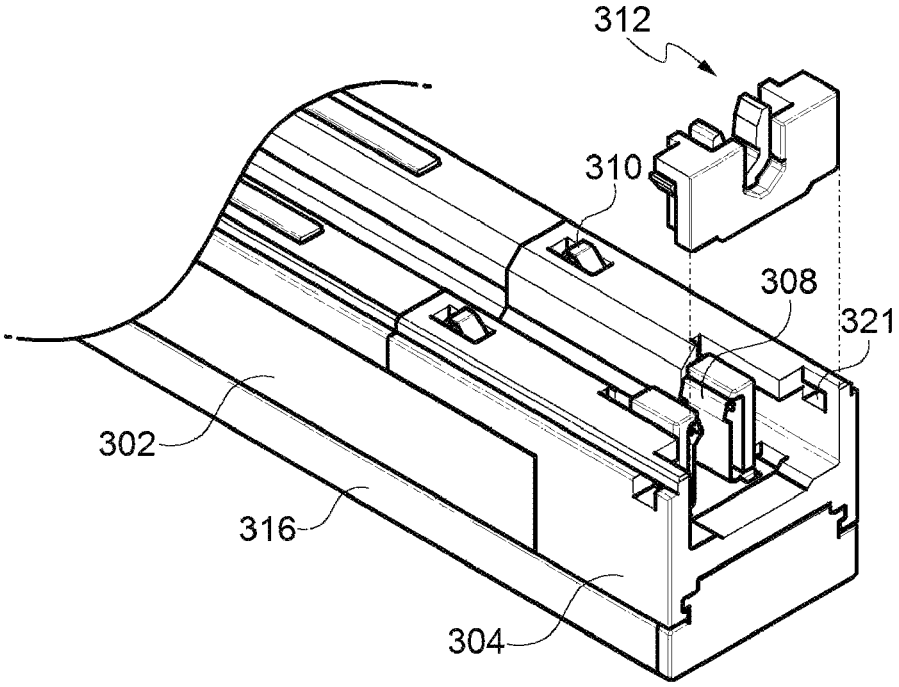
FIG. 8 is a view illustrating a state in which a rail coupling part is coupled to the body-coupling part in the lighting unit according to an embodiment of the present invention.
Figure 9:
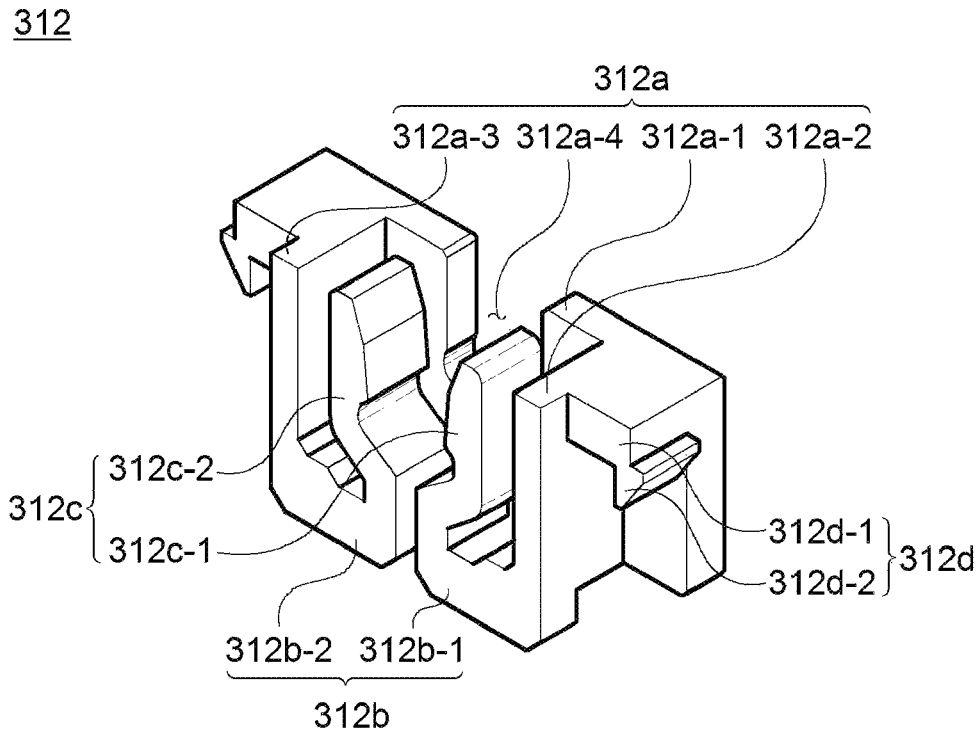
FIG. 9 is a front perspective view illustrating the rail coupling part according to an embodiment of the present invention.
Figure 10:
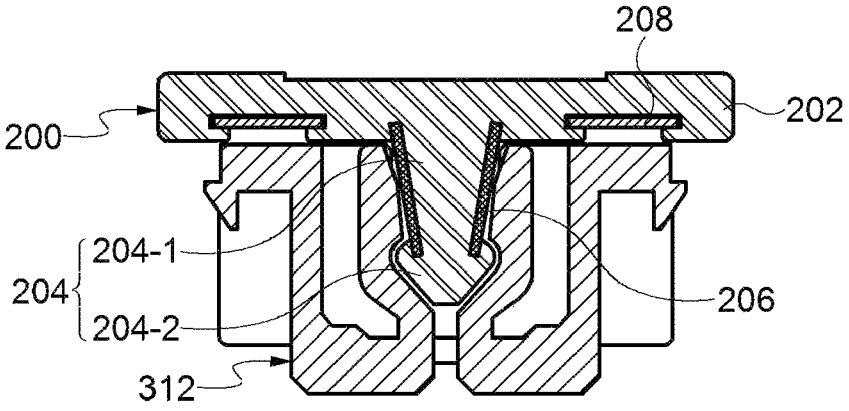
FIG. 10 is a cross-sectional view illustrating a state in which the rail coupling part is coupled with a coupling projection part according to an embodiment of the present invention.

FIG. 8 is a view illustrating a state in which the rail coupling part 312 is coupled to the body-coupling part 304 in the lighting unit 300 according to an embodiment of the present invention, FIG. 9 is a front perspective view illustrating the rail coupling part 312 according to an embodiment of the present invention, and FIG. 10 is a cross-sectional view illustrating a state in which the rail coupling part 312 is coupled with the coupling projection part 204 according to an embodiment of the present invention.

Referring to FIGS. 8 to 10, the rail coupling part 312 may be coupled with the body-coupling part 304 as inserted from an upper portion to a lower portion of an end of the body-coupling part 304. The rail coupling part 312 may include a basic frame 312*a*, a connection part 312*b*, a first elastic coupling part 312*c*, and a second elastic coupling part 312*d*.

The basic frame 312*a* may include a first basic frame 312*a*-1, a second basic frame 312*a*-2, and a third basic frame 312*a*-3. The first basic frame 312*a*-1 may be disposed in a width direction of the body-coupling part 304. The first basic frame 312*a*-1 may be seated on an end of the base plate 302*a*. A projection part insertion groove 312*a*-4 to which the coupling projection part 204 is insertable may be defined in a central portion of the first basic frame 312*a*-1. The projection part insertion groove 312*a*-4 may have a shape corresponding to the coupling projection part 204.

The second basic frame 312*a*-2 may protrude perpendicularly to the first basic frame 312*a*-1 at one side of one surface (a face facing the first connection part 308) of the first basic frame 312*a*-1. The third basic frame 312*a*-3 may protrude perpendicularly to the first basic frame 312*a*-1 at the other side of the one surface of the first basic frame 312*a*-1. The third basic frame 312*a*-3 may be spaced apart from the second basic frame 312*a*-2.

The connection part 312*b* may connect the basic frame 312*a* and the first elastic coupling part 312*c*. Here, the first elastic coupling part 312*c* may include a first-1 elastic coupling part 312*c*-1 and a first-2 elastic coupling part 312*c*-2. Also, the connection part 312*b* may include a first connection part 312*b*-1 and a second connection part 312*b*-2.

The first connection part 312*b*-1 may connect the second basic frame 312*a*-2 and the first-1 elastic coupling part 312*c*-1. The first connection part 312*b*-1 may be perpendicular inward from an end of the second basic frame 312*a*-2.

The second connection part 312*b*-2 may connect the third basic frame 312*a*-3 and the first-2 elastic coupling part 312*c*-2. The second connection part 312*b*-2 may be perpendicular inward from an end of the third basic frame 312*a*-3.

That is, the first connection part 312*b*-1 and the second connection part 312*b*-2 may face each other between ends of the second basic frame 312*a*-2 and the third basic frame 312*a*-3. Ends of the first connection part 312*b*-1 and the second connection part 312*b*-2, which face each other, may be spaced apart from each other. The first connection part 312*b*-1 and the second connection part 312*b*-2 may be inserted to the first accommodation hole 304*a*-1 of the body-coupling part 304 and seated on one surface of the lighting part 306.

The first elastic coupling part 312*c* may include a first-1 elastic coupling part 312*c*-1 and a first-2 elastic coupling part 312*c*-2. The first-1 elastic coupling part 312*c*-1 may be disposed perpendicularly to an end of the first connection part 312*b*-1. The first-1 elastic coupling part 312*c*-1 may have a shape corresponding to that of one side of the coupling projection part 204. The first-1 elastic coupling part 312*c*-1 may be spaced apart from each of the first basic frame 312*a*-1 and the second basic frame 312*a*-2. Thus, the first-1 elastic coupling part 312*c*-1 may have an elastic force.

The first-2 elastic coupling part 312*c*-2 may be disposed perpendicularly to an end of the second connection part 312*b*-2. The first-2 elastic coupling part 312*c*-2 may have a shape corresponding to that of the other side of the coupling projection part 204. The first-2 elastic coupling part 312*c*-1 may be spaced apart from each of the first basic frame 312*a*-1 and the third basic frame 312*a*-3. Thus, the first-2 elastic coupling part 312*c*-2 may have an elastic force.

When the rail unit 200 is coupled with the lighting unit 300, while the coupling projection part 204 is inserted between the first-1 elastic coupling part 312*c*-1 and the first-2 elastic coupling part 312*c*-2, both sides of the coupling projection part 204 may be coupled to the first-1 elastic coupling part 312*c*-1 and the first-2 elastic coupling part 312*c*-2, respectively.

The second elastic coupling part 312*d* may be disposed at each of both sides of one surface of the first basic frame 312*a*-1. The second elastic coupling part 312*d* may include an elastic connection part 312*d*-1 and a protruding part 312*d*-2.

The elastic connection part 312*d*-1 may be connected to each of the both sides of the one surface of the first basic frame 312*a*-1. In an exemplary embodiment, the elastic connection part 312*d*-1 may be connected to the top of the one surface of the first basic frame 312*a*-1. The elastic connection part 312*d*-1 may be also connected to a side surface of the second basic frame 312*a*-2 and a side surface of the third basic frame 312*a*-3.

The protruding part 312*d*-2 may protrude from the bottom of the elastic connection part 312*d*-1 in outside and downward directions. The protruding part 312*d*-2 may include a section in which a width gradually decreases in the downward direction. That is, the protruding part 312*d*-2 may be inclined inward.

When the rail coupling part 312 descends from the upper portion to the lower portion of the end of the body-coupling part 304, the second elastic coupling part 312*d* may be inserted to and caught by a catching hole 321 defined in each of both side surfaces of the body-coupling part 304. Thus, the rail coupling part 312 and the body-coupling part 304 may be coupled to each other.

Referring to FIGS. 2 and 3 again, the magnet material accommodation part 314 may be coupled with the body part 302 at an upper portion of the body part 302. The magnet material accommodation part 314 may be coupled with the body part 302 between one pair of body-coupling parts 304. The magnet material accommodation part 314 may have one end that closely contacts an end of the body-coupling part 304 coupled to one side of the body part 302. The magnet material accommodation part 314 may have the other end that closely contacts an end of the body-coupling part 304 coupled to the other side of the body part 302.

The magnet material accommodation part 314 may be slide-coupled along the first guide part 302*b* of the body part 302. That is, the magnet material accommodation part 314 may be slide-coupled to the first guide part 302*b*. A space to which the first guide part 302*b* is inserted may be defined in the magnet material accommodation part 314. Also, the bottoms of both sides of the magnet material accommodation part 314 may be slid while being inserted to the first-1 guide groove 302*b*-1 and the first-2 guide groove 302*b*-2.

The magnet material accommodation part 314 may be made of an insulating material. A magnet material accommodation groove 314*a* in which the magnet material 318 is accommodated may be defined in the magnet material accommodation part 314. The magnet material 318 may be fixed in the magnet material accommodation groove 314*a*. The magnet material 318 may be mounted to be attached to and detached from the magnet material accommodation groove 314*a*. The magnet material 318 may be electrically insulated from the body part 302 made of a metal material by the magnet material accommodation part 314.

In an exemplary embodiment, the magnet material 318 may be inserted to the magnet material accommodation groove 314*a* from a lower portion of the magnet material accommodation part 314, and the top of the magnet material 318 may be exposed to the outside of the magnet material accommodation groove 314*a*.

Also, an insulating tape may be provided between the magnet material 318 and the magnet material accommodation part 314 to electrically insulate the magnet material 318 from the body part 302. However, the embodiment of the present invention is not limited thereto. For example, various structures and units that insulate the magnet material 318 from the body part 302 may be applied.

According to the disclosed embodiment, as the magnet material 318 is inserted to and accommodated in the magnet material accommodation groove 314*a* of the magnet material accommodation part 314, the magnet material 318 may be easily inserted to the lighting unit 300. That is, although the magnet material is typically inserted by a separate mechanical device using an interference fit method, the magnet material 318 may be inserted through simple assembly according to an embodiment of the present invention.

The magnet material 318 may be disposed in correspondence to the second conductive line 208. Although the magnet material 318 may be a conductor, the embodiment of the present invention is not limited thereto. For example, the magnet material 318 may be a non-conductor. The magnet material 318 may be magnetically coupled with the second conductive line 208 when the rail unit 200 is coupled with the lighting unit 300. That is, the physical coupling between the rail unit 200 and the lighting unit 300 is primarily performed by the coupling between the rail coupling part 312 and the coupling projection part 204 and secondarily performed by the coupling between the magnet material 318 and the second conductive line 208.

The diffusion part 316 may be disposed at a lower portion of the body part 302. The diffusion part 316 may be slide-coupled to the lower portion of the body part 302. The diffusion part 316 may be slide-coupled to the lower portion of the body part 302 along the second guide part 302*c*. A second slide coupling part 316*a* may be provided at each of the tops of both sides of the diffusion part 316 along a lengthwise direction of the diffusion part 316. The second slide coupling part 316*a* may be slid while being inserted to the second guide groove 302*c*-1.

The diffusion part 316 may have a length greater than that of the body part 302. Both sides of the diffusion part 316 may protrude to the outside of the body part 302 in a state in which the diffusion part 316 is coupled to the body part 302. A finishing member 320 may be coupled to each of both ends of the diffusion part 316.

Here, the bottoms of the body-coupling part 304 may be slide-coupled to the outwardly protruding both ends of the diffusion part 316. That is, a third guide groove 304*f* defined in the bottom of the body-coupling part 304 may be slide-coupled to the second slide coupling part 316*a* of the diffusion part 316. In this case, the guide coupling part 304*d* of the body-coupling part 304 may be slide-coupled to the first guide part 302*b* of the body part 302. That is, the body-coupling part 304 may be slide-coupled to each of the diffusion part 316 and the body 302, i.e., dually slide-coupled thereto.

In an exemplary embodiment, when an assembly sequence of the lighting unit 300 is simply described, the diffusion part 316 may be slide-coupled to the bottom of the body part 302 in a state in which the lighting part 306 to which the first connection part 308 and the second connection part 310 are mounted is fixed to the lower portion of the body part 302. That is, the second slide coupling part 316*a* of the diffusion part 316 may be slide-coupled while being inserted to the second guide groove 302*c*-1 of the body part 302. Then, both ends of the diffusion part 316 may protrude from both ends of the body part 302.

Also, the magnet material accommodation part 314 in which the magnet material 318 is accommodated may be slide-coupled to the top of the body part 302. That is, the bottoms of the both sides of the magnet material accommodation part 314 may be slide-coupled while being inserted to the first-1 guide groove 302*b*-1 and the first-2 guide groove 302*b*-2. Here, an assembly sequence of the diffusion part 316 and the magnet material 318 may be exchanged.

Thereafter, the body-coupling part 304 may be slide-coupled to both ends of the body part 302. In this case, the guide coupling part 304*d* of the body-coupling part 304 may be slide-coupled while being inserted to the first-1 guide groove 302*b*-1 and the first-2 guide groove 302*b*-2. Also, the second slide coupling part 316*a* of the diffusion part 316 may be slide-coupled to the third guide groove 304*f* of the body-coupling part 304. Here, a front end of the base plate 304*a* of the body-coupling part 304 and an end of one side of the body part 302 may closely contact and coupled to each other.

Thereafter, as the rail coupling part 312 is pressed downward from an upper portion of the end of the body-coupling part 304, the rail coupling part 312 may be coupled to the body-coupling part 304. However, the embodiment of the present invention is not limited thereto. For example, the body-coupling part 304 may be slide-coupled to the both ends of the body part 302 in a state in which the rail coupling part 312 is coupled with the body-coupling part 304.

However, the embodiment of the present invention is not limited thereto. For example, the lighting unit 300 may have various assembly sequences. For example, the magnet material accommodation part 314 in which the magnet material 318 is accommodated may be slide-coupled to the top of the body part 302, and then the body-coupling part 304 may be slide-coupled to the both ends of the body part 302. Then, the rail coupling part 312 may be coupled to the body-coupling part 304 by pressing the rail coupling part 312 from the upper portion to the lower portion of the end of the body-coupling part 304. Thereafter, the lighting part 306 may be fixed to the lower portion of the body part 302, and then the diffusion part 316 may be slide-coupled to the bottom of the body part 302.

According to the disclosed embodiment, since components are coupled through mutual slide-coupling, a separate coupling member is unnecessary. Thus, the number of the components may be reduced, assembly between the components may be easily performed, and assembly time may be reduced.

Figure 11:
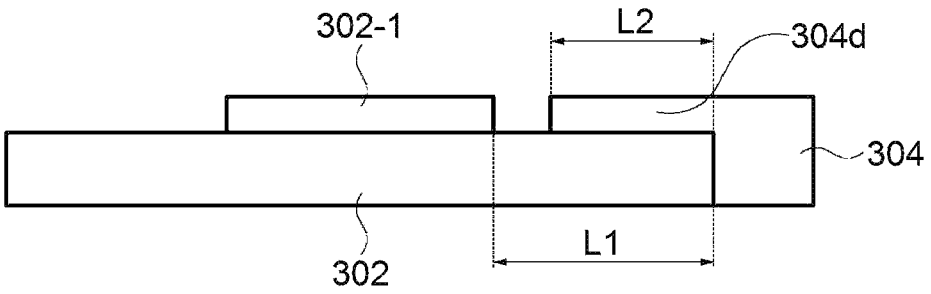
FIG. 11 is a schematic view illustrating a lighting unit according to another embodiment of the present invention.

FIG. 11 is a schematic view illustrating a lighting unit according to another embodiment of the present invention.

Referring to FIG. 11, a protruding part 302-1 may be provided at a central portion of a body part 302. The protruding part 302-1 may protrude upward from the central portion of a body part 302 (protrude toward a rail unit 200). The protruding part 302-1 may have a length less than that of the body part 302. Thus, both ends of the protruding part 302-1 may form stepped portions on one surface (a surface on which a guide coupling part 304*d* is seated) of the body part 302. The protruding part 302-1 may constitute a portion of the one surface (a surface facing the rail unit 300) of a lighting unit 300.

When a distance from one end of the body part 302 to one end of the protruding part 302-1 is a first distance L1, a second distance L2 that is a distance between the one end of the body part 302 to an end of the top of a body-coupling part 304 may be equal to or less than the first distance L1 in a state in which the bottom of the body-coupling part 304 closely contacts and is coupled to the one end of the body part 302. That is, the second distance L2 may be equal to or less than the first distance L1.

Here, the second distance L2 may be a length of the guide coupling part 304*d* of the body-coupling part 304.

When the second distance L2 is less than the first distance L1, a spaced space corresponding to a difference between the second distance L2 and the first distance L1 may be defined between the one end of the protruding part 302-1 and the end of the top of the body-coupling part 304. In an exemplary embodiment, the protruding part 302-1 may be a magnet material accommodation part 314. However, the embodiment of the present invention is not limited thereto. FIG. 2 illustrates an embodiment in which the protruding part 302-1 is the magnet material accommodation part 314, and the first distance is equal to the second distance.

Figure 12:
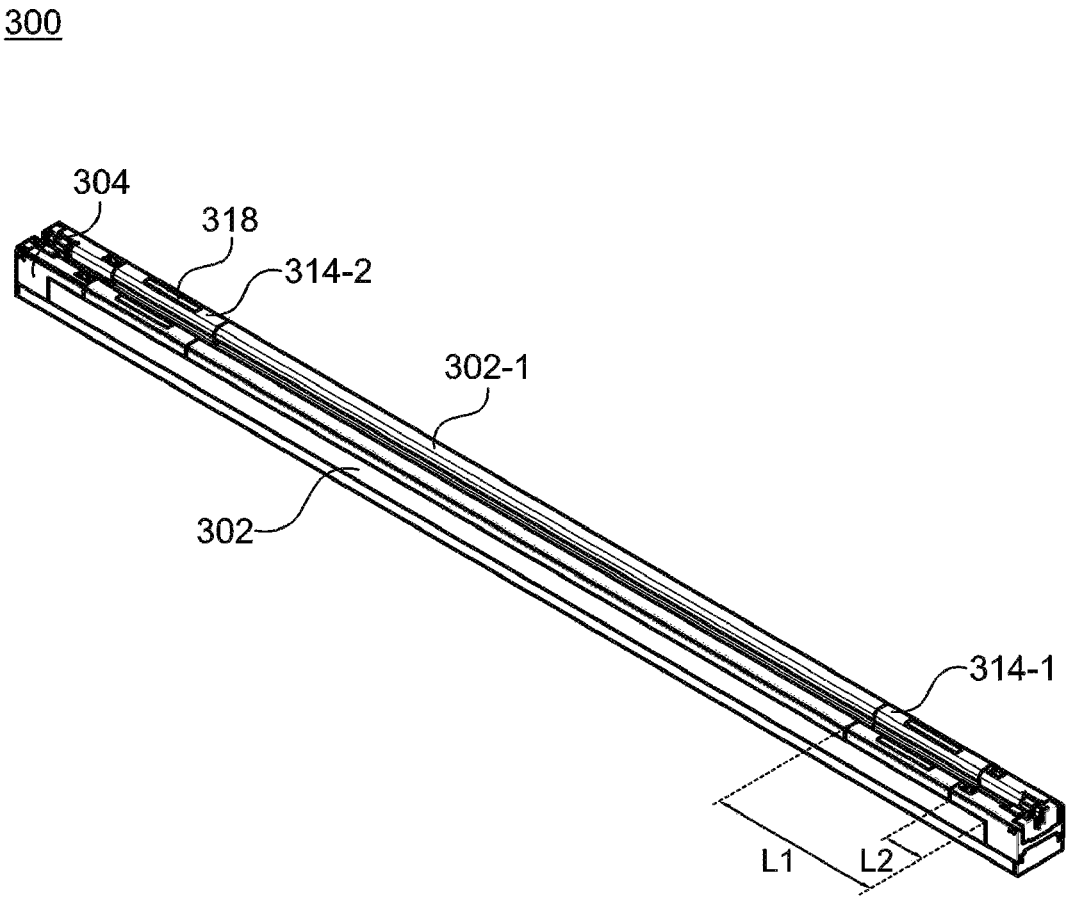
FIG. 12 is a view illustrating a state in which a lighting unit extends in length according to an embodiment of the present invention.

On the other hand, the lighting unit 300 may be variously changed in length depending on necessity. For example, as illustrated in FIG. 12, a lighting unit 300 may have an extended length. As the lighting unit 300 has the extended length, a first magnet material accommodation part 314-1 may closely contact a body-coupling part 304 provided at one side of the lighting unit 300, and a second magnet material accommodation part 314-2 may closely contact a body-coupling part 304 provided at the other side of the lighting unit 300. Also, a protruding part 302-1 may be disposed on the body part 302 between the first magnet material accommodation part 314-1 and the second magnet material accommodation part 314-2. Here, the first distance L1 may be greater than the second distance L2.

In other words, the first magnet material accommodation part 314-1 and the second magnet material accommodation part 314-2 may be disposed in spaced spaces (corresponding to the difference between the second distance L2 and the first distance L1) between the both ends of the protruding part 302-1 and the end of the top of the body-coupling part 304, respectively. Here, the protruding part 302-1 may be variously changed in length, and thus each of the spaced spaces in the lighting unit 300 may be changed in length.

In an exemplary embodiment, a length adjustment member for adjusting the length of the lighting unit 300 (e.g., a member having the same or similar shape as the magnet material accommodation part and excluding a magnet material) may be additionally provided in the spaced space in addition to the magnet material accommodation part. Also, at least one of the magnet material accommodation part and the length adjustment member may be provided in the spaced space. For example, the magnet material accommodation part and the length adjustment member may be combined and arranged with various sequences in the spaced space.

As described above, as the second distance L2 is equal to or less than the first distance L1, the lighting unit 300 may be variously adjusted in length. In an exemplary embodiment, when the second distance L2 is less than the first distance L1, the number of the magnet material accommodation parts may increase to increase a coupling force with the rail unit 200 as in FIG. 12. Also, one surface of the lighting unit 300 may be adjusted in length to remove an empty space, and thus the lighting unit 300 may have a clean appearance.

Figure 13:
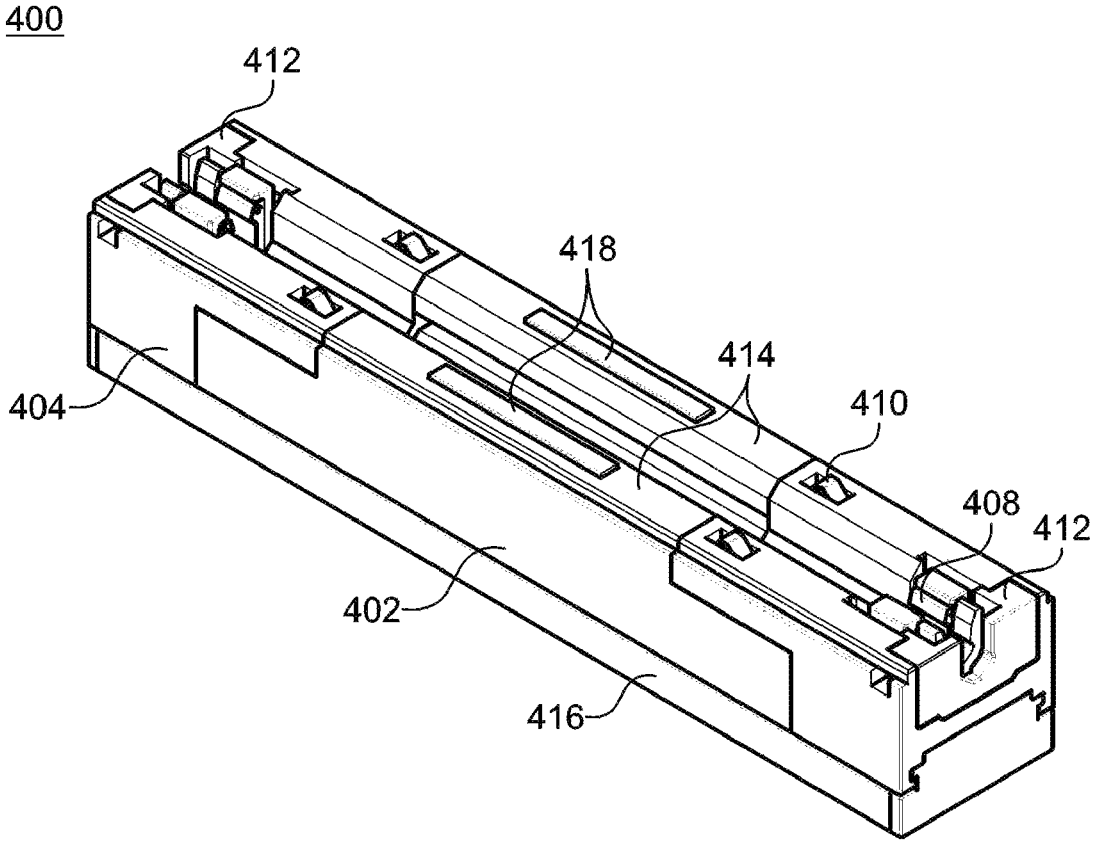
FIG. 13 is a perspective view illustrating a lighting unit according to another embodiment of the present invention.

FIG. 13 is a perspective view illustrating a lighting unit according to another embodiment of the present invention. Here, a different point from the embodiment in FIGS. 2 and 3 will be mainly described.

Referring to FIG. 13, a body part 402 of the lighting unit 400 may be integrated with a magnet material accommodation part 414. That is, the body part 402 may include the magnet material accommodation part 414 in which a magnet material 418 is accommodated. In this case, the body part 402 and the magnet material accommodation part 414 may be made of an insulating material. In an exemplary embodiment, the lighting unit 400 may include a lighting part (not shown) having a spot lighting shape. The spot lighting shaped lighting part (not shown) may be mounted to a lower portion of the body part 402 in a rotatable manner.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed. Therefore, the scope of this disclosure is defined not by the detailed description of the invention but by the appended claims, and all differences within the scope will be construed as being included in the present disclosure.

The invention claimed is:

1. A lighting unit comprising:

a body part comprising a body plate and a first guide part disposed on the top of the body plate in a lengthwise direction of the body plate;

a magnet material accommodation part disposed at an upper portion of the body part to accommodate a magnet material magnetically coupled with a rail unit; and a body-coupling part that is slide-coupled to each of both ends of the body part along the first guide part, wherein the rail unit comprises a coupling projection part that protrudes toward the lighting unit, and the lighting unit further comprises a rail coupling part fixed to the body-coupling part and coupled with the coupling projection part; and the rail coupling part is pressed from an upper portion to a lower portion of an end of the body-coupling part and coupled with the body-coupling part, wherein the lighting unit further comprises:

a first connection part that is electrically connected to a first conductive line of the rail unit;

a second connection part that is electrically connected to a second conductive line of the rail unit;

a first accommodation hole defined in the body-coupling part to accommodate the first connection part; and a third accommodation hole defined in the body-coupling part to expose the top of the second connection part.

2. The lighting unit of claim 1, wherein a protruding part that protrudes toward the rail unit is disposed at a central portion of the body part, the body-coupling part has the bottom that closely contacts one end of the body part and the top that protrudes from the body part to the magnet material accommodation part, and a distance between the one end of the body part to an end of the top of the body-coupling part is equal to or less than that between the one end of the body part to one end of the protruding part.

3. The lighting unit of claim 1, wherein the rail coupling part comprises:

a basic frame seated on an end of the body-coupling part and comprising a projection part insertion groove to which the coupling projection part is inserted;

a connection part disposed on one surface of the basic frame; and a first elastic coupling part disposed on an end of the connection part and to which the coupling projection part is inserted and coupled.

4. The lighting unit of claim 3, wherein the first elastic coupling part comprises a first-1 elastic coupling part and a first-2 elastic coupling part, the basic frame comprises a first basic frame, a second basic frame that protrudes from one side of one surface of the first basic frame, and a third basic frame that protrudes from the other side of the one surface of the first basic frame, and the connection part comprises a first connection part disposed inward from the bottom of the second basic frame to connect the second basic frame and the first-1 elastic coupling part and a second connection part disposed inward from the bottom of the third basic frame to connect the third basic frame and the first-2 elastic coupling part.

5. The lighting unit of claim 3, wherein the lighting unit comprises a second elastic coupling part disposed on each of both sides of the basic frame; and a catching hole defined in each of both side surfaces of the body-coupling part and to which the second elastic coupling part is inserted and caught.

6. The lighting unit of claim 1, wherein the magnet material accommodation part is slide-coupled to the top of the body part along the first guide part.

7. The lighting unit of claim 1, wherein the body part is made of a metal material, the magnet material accommodation part is made of an insulating material, and the magnet material is electrically insulated from the body part by the magnet material accommodation part.

8. The lighting unit of claim 1, wherein the first guide part protrudes upward from each of both sides of the body plate, the lighting unit comprises a first-1 guide groove defined in an inside of the first guide part in a lengthwise direction of the first guide part and a first-2 guide groove defined in an outside of the first guide part in the lengthwise direction of the first guide part, and the magnet material accommodation part has an inner space to which the first guide part is inserted and both side bottoms that are inserted to and slid along the first-1 guide groove and first-2 guide groove, respectively.

9. The lighting unit of claim 1, wherein the lighting unit further comprises a connection part that is electrically connected to a conductive line of the rail unit, and the top of the connection part has a height greater than that of the magnet material.

10. The lighting unit of claim 1, wherein the lighting unit further comprises a second accommodation hole defined in the body part to accommodate the second connection part.

11. The lighting unit of claim 10, wherein the body-coupling part comprises:

a base plate disposed along a lengthwise direction of the lighting unit;

a first side plate disposed at one side of the base plate;

a second side plate disposed at the other side of the base plate; and a guide coupling part that protrudes from the tops of the first side plate and the second side plate to the body part and is slide-coupled to the first guide part.

12. The lighting unit of claim 11, wherein the accommodation hole disposed in communication with the second accommodation hole in the guide coupling part.

13. The lighting unit of claim 11, wherein the body-coupling part comprises: a protruding connection part that protrudes toward the first accommodation hole from an inside of the base plate; a vertical part disposed perpendicularly to an end of the protruding connection part in an upward direction; and a cover part that protrudes from an end of the vertical part to the first connection part to cover the top of the first connection part.

14. The lighting unit of claim 1, wherein the body part and the magnet material accommodation part are integrated with each other, and each of the body part and the magnet material accommodation part is made of an insulating material.

15. A lighting unit that is coupled with a rail unit, in which a coupling projection part protrudes from one surface thereof and at least one conductive line is disposed along a lengthwise direction thereof, and is electrically connected to the rail unit, comprising:

a body part;

a lighting part disposed at a lower portion of the body part;

one pair of body-coupling parts coupled to both ends of the body part, respectively;

a rail coupling part fixed to the body-coupling part and coupled with the coupling projection part;

a magnet material accommodation part disposed between the one pair of body-coupling parts on the top of the body part; and a magnet material accommodated in the magnet material accommodation part and magnetically coupled with the conductive line, wherein the rail coupling part is pressed from an upper portion to a lower portion of an end of the body-coupling part, wherein the lighting unit further comprises:

a first connection part that is electrically connected to a first conductive line of the rail unit;

a second connection part that is electrically connected to a second conductive line of the rail unit;

a first accommodation hole defined in the body-coupling parts to accommodate the first connection part; and a third accommodation hole defined in the body-coupling part to expose the top of the second connection part.

16. A rail type lighting device comprising: a mounting unit mounted to an installation surface; a rail unit coupled with the mounting unit and disposed in a lengthwise direction of the mounting unit; and a lighting unit that is coupled with the rail unit, electrically connected with the rail unit, and movable along the rail unit, wherein the rail unit comprises:

a rail body coupled with the mounting unit inside the mounting unit;

a coupling projection part that protrudes from one surface of the rail body; and a conductive line disposed along a lengthwise direction of the rail body on at least one of both side surfaces of the coupling projection part and one surface of the rail body, and the lighting unit comprises:

a body part;

a magnet material accommodation part disposed at an upper portion of the body part;

a magnet material accommodated in the magnet material accommodation part and magnetically coupled with the conductive line; and a lighting part connected to the body part and configured to receive power from the conductive line, wherein the body part comprises a body plate and a first guide part disposed in a lengthwise direction of the body plate on the top of the body plate, and the lighting unit further comprises a body-coupling part that is slide-coupled to each of both ends of the body part along the first guide part; and a rail coupling part fixed to the body-coupling part and coupled with the coupling projection part, wherein the rail coupling part is pressed from an upper portion to a lower portion of an end of the body-coupling part and coupled with the body-coupling part, wherein the lighting unit further comprises:

a first connection part that is electrically connected to a first conductive line of the rail unit;

a second connection part that is electrically connected to a second conductive line of the rail unit;

a first accommodation hole defined in the body-coupling part to accommodate the first connection part; and a third accommodation hole to expose the top of the second connection part.

* * * * *